United States Patent [19]

Kleykamp et al.

[11] 4,239,007

[45] Dec. 16, 1980

[54] RAILWAY TRUCK PEDESTAL LINER

[75] Inventors: Donald L. Kleykamp, Springboro; Peter J. Neroni, Dayton, both of Ohio

[73] Assignee: Dayco Corporation, Dayton, Ohio

[21] Appl. No.: 30,036

[22] Filed: Apr. 13, 1979

[51] Int. Cl.[3] ..... B61F 5/32; F16C 27/02; F16C 33/20; F16C 33/24

[52] U.S. Cl. ..... 105/225; 105/207; 308/3 R; 308/238

[58] Field of Search ..... 105/225, 207, 199 C; 308/3 R, 238

[56] References Cited

U.S. PATENT DOCUMENTS

| | | | |
|---|---|---|---|
| 2,295,520 | 9/1942 | Parke | 105/225 |
| 3,554,618 | 1/1971 | Ditzler et al. | 308/3 R |
| 4,001,124 | 1/1977 | Hussey | 105/225 X |
| 4,188,888 | 2/1980 | Cooper et al. | 105/199 C |

*Primary Examiner*—Howard Beltran
*Attorney, Agent, or Firm*—Reuben Wolk; Charles E. Bricker

[57] ABSTRACT

A pedestal liner for a pedestal truck of a railway vehicle is provided wherein such pedestal liner is of roughly U-shaped configuration having a bight and a pair of parallel legs. A continuous uninterrupted backing material defining the bight and parallel legs, and a first antifriction material for the bight fixed against the backing material to engage a vertically disposed planar guide surface of an associated journal box. A second antifriction material for the parallel legs fixed against the backing material to engage vertically disposed parallel side surfaces of the journal box which are disposed on opposite sides of the guide surface with the backing material providing optimum structural support for the antifriction materials and the first and second antifriction materials having different wear characteristics determined by the different wear rates to which they are subjected.

10 Claims, 5 Drawing Figures

RAILWAY TRUCK PEDESTAL LINER

CROSS-REFERENCE TO RELATED APPLICATION

This application is related to U.S. patent application Ser. No. 30,035 filed concurrently herewith on Apr. 13, 1979.

BACKGROUND OF THE INVENTION

1. Field of the Invention

This invention relates to railway vehicles and in particular to pedestal liners for pedestal trucks of such vehicles.

2. Prior Art Statement

It is known in the art to provide a wear member supported by at least one of a pair of relatively movable components of a railway vehicle for the purpose of protecting the components from wear. However, heretofore it has been common practice to provide a wear member made either entirely of a hard metal or entirely of a hard polymeric material and such wear member is suitably supported in position between such components and once the wear member becomes excessively worn it is removed and a new one installed in its position. However, metal wear members are usually made of comparatively expensive metallic materials and do not have optimum antifriction properties while wear members made entirely of polymeric material have comparatively poor structural strength and thus are often easily broken requiring frequent replacement.

It has also been proposed heretofore to provide so-called wear members or liners for center plate structure of a railway vehicle with reinforcing material embedded therein as disclosed in U.S. Pat. No. 4,188,888; however, such liners have minimum structural strength and in use are confined between associated supporting surfaces.

Further, it has been proposed in U.S. Pat. No. 3,554,618 to provide a U-shaped pedestal liner consisting of a bight and a pair of parallel legs which has an inserted nylon wear plate for the bight which is unsupported in the central portion of the bight and which is free of antifriction material on the outside surfaces of the parallel legs where substantial wear may also occur in a pedestal liner.

It has also been proposed in U.S. patent application Ser. No. 27,340, filed Apr. 5, 1979, to provide a wear member comprising a support having a continuous planar supporting surface, a polymeric antifriction wear material, and means attaching the polymeric material to the support and supporting same against the continuous supporting surface for the purpose of providing a substantially structurally self-supporting wear member; however, basically in such a member the teaching is to the use of a supported flat planar polymeric antifriction material in a single plane.

In addition, it has been proposed in the above cross-referenced U.S. patent application Ser. No. 30,035 to provide a roughly U-shaped pedestal liner having a continuous backing material and a particular antifriction material bonded against both the bight and parallel legs of the backing material.

SUMMARY

It is a feature of this invention to provide a pedestal liner for a railway vehicle wherein such vehicle comprises pedestal trucks comprising pairs of pedestal legs and a journal box disposed between each pair of pedestal legs with each journal box having a vertically disposed planar central guide surface and a pair of spaced vertically disposed parallel side surfaces disposed on opposite sides of the guide surface and wherein the pedestal liner is roughly U-shaped having a bright and a pair of parallel legs and is for disposal between an associated pedestal leg and journal box and such pedestal liner has a continuous uninterrupted backing material defining its bight and parallel legs, a first antifriction material for the bight fixed against the backing material and adapted to engage the guide surface, a second antifriction material for the parallel legs fixed against the backing material and adapted to engage the side surfaces, with the backing material providing optimum structural support for the antifriction materials and the first and second antifriction materials having different wear characteristics compatible with the different wear rates to which they are subjected.

Another feature of this invention is to provide a pedestal liner of the character mentioned in which the first and second antifriction materials are polymeric materials.

Another feature of this invention is to provide a pedestal liner of the character mentioned in which the backing material is a metal plate structure.

Another feature of this invention is to provide a pedestal liner of the character mentioned in which one of the polymeric antifriction materials is an ultra high molecular weight polyethylene and the other of the polymeric antifriction materials is nylon.

Another feature of this invention is to provide a pedestal liner of the character mentioned in which the ultra high molecular weight polyethylene has a preferred molecular weight in the range of 4 to 6 million.

Another feature of this invention is to provide an improved method of making a pedestal liner of the character mentioned.

Therefore, it is an object of this invention to provide an improved pedestal liner and method of making same having one or more of the novel features set forth above or hereinafter shown or described.

Other details, features, uses, objects, and advantages of this invention will become apparent from the embodiments thereof presented in the following specification, claims, and drawing.

BRIEF DESCRIPTION OF THE DRAWING

The accompanying drawing shows present preferred embodiments of this invention, in which.

DESCRIPTION OF ILLUSTRATED EMBODIMENTS

Figure 1:
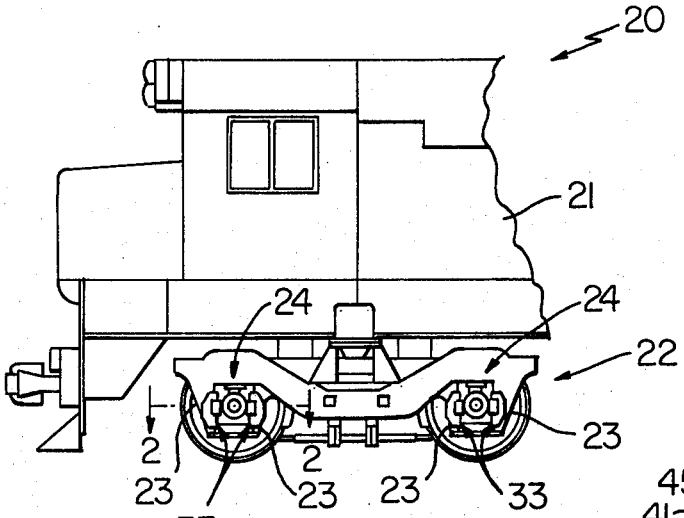
FIG. 1 is a fragmentary side view of a railway locomotive comprising pedestal trucks having pairs of pedestal legs and a journal box disposed between each pair of pedestal legs and which utilizes a pedestal liner of this invention between each associated pedestal leg and journal box.

Reference is now made to FIG. 1 of the drawing which illustrates an exemplary railway vehicle shown as the forward portion of a railway locomotive which is designated generally by the reference numeral 20. The railway locomotive comprises the usual locomotive main body 21 supported at opposite ends thereof by four-wheel trucks, only one of which is shown in the drawing, and designated generally by the reference numeral 22. Each truck 22 is a so-called pedestal truck which is well known in the art and thus will not be discussed herein in detail. Each truck 22 comprises four pairs of pedestal legs with two of such pairs being illustrated in FIG. 1 and each leg of each pair of legs is designated by the reference numeral 23. A journal box 24 is disposed between each pair of pedestal legs 23 as is known in the art.

Figure 2:
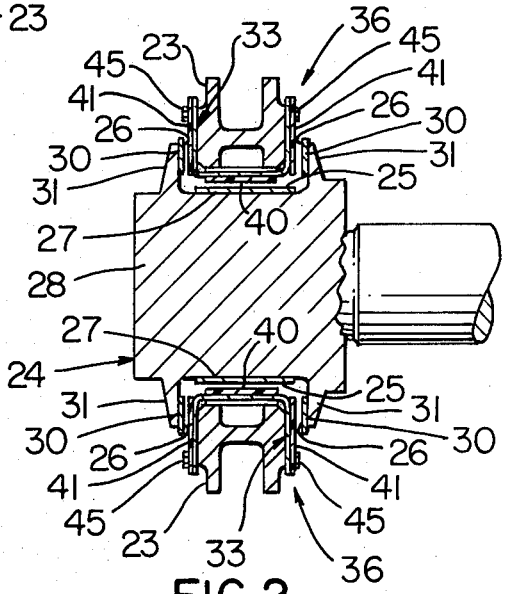
FIG. 2 is a fragmentary cross-sectional view taken essentially on the line 2—2 of FIG. 1 particularly illustrating a pair of pedestal liners of this invention disposed in position between an associated journal box and an associated pair of pedestal legs.

As best seen in FIG. 2 of the drawing each journal box 24 has a vertically disposed central planar guide surface 25 on each side thereof and a pair of spaced vertically disposed parallel side surfaces each designated by the same reference numeral 26 disposed on opposite sides of each central guide surface 25. Each central guide surface 25 in this example of the invention defines the outside surface of a member 27 which may be in the form of a wear plate which is suitably fixed to the main body 28 of the journal box 24. The side surfaces 26 of the journal box 24 comprise plate members 30 which are suitably fixed to integral flanges 31 defined as extensions of the main body 28 of the journal box 24.

Figure 3:
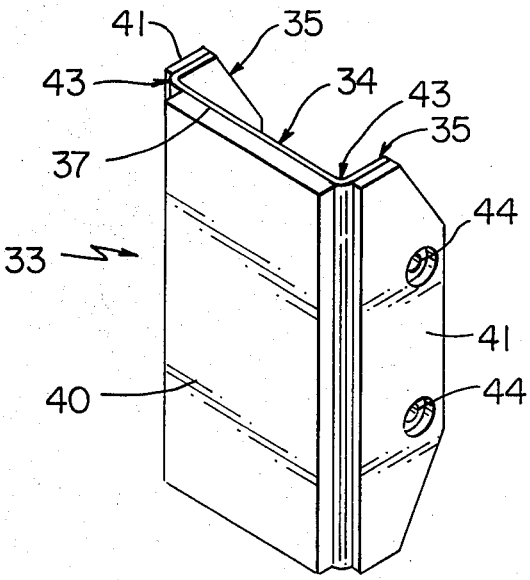
FIG. 3 is a perspective view illustrating a typical pedestal liner of this invention utilized in the pedestal trucks of FIG. 1.

Each pedestal liner is designated generally by the reference numeral 33 and a typical completed pedestal liner is illustrated in perspective view in FIG. 3. Each pedestal liner 33 is roughly U-shaped having a bight designated generally by the reference numeral 34 and a pair of legs each designated by the same reference numeral 35; and, the U-shaped pedestal liner 33 is particularly adapted for disposal between an associated pedestal leg 23 and the journal box 24 and as shown at two typical locations 36 in FIG. 2.

Figure 4:
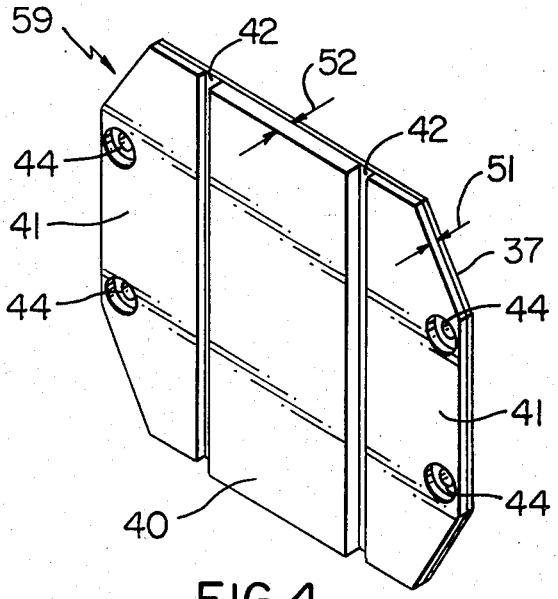
FIG. 4 is a perspective view illustrating a flat assembly or workpiece which is utilized in making the pedestal liner of FIG. 3.

As seen in FIGS. 3 and 4, the pedestal liner 33 comprises a continuous uninterrupted backing material which in this example is shown as a continuous metal sheet or plate 37. The pedestal liner 33 also has a first antifriction material 40 for the bight 34 thereof fixed against the backing material 37 and such antifriction material 40 is adapted to engage an associated guide surface 25. The pedestal liner 33 also has a second antifriction material 41 for the parallel legs 35 thereof fixed against the backing material 37 and the antifriction material 41 is adapted to engage the side surfaces 26 provided on wear plates 30 which are in turn fixed to the flanges 31 of the journal box 24.

The antifriction materials 40 and 41 are fixed to the backing material 37 utilizing any suitable means or technique known in the art and certain techniques are described in the above cross-referenced U.S. Patent application Ser. No. 30,035 the disclosure of which is incorporated herein by reference thereto. The backing material 37 is a continuous uninterrupted metal backing material preferably made from a suitable metallic material in the form of a plate which has rigidity and comparatively high strength whereby such backing material provides optimum structural support for the antifriction material and in particular for the antifriction material 40 fixed to the bight 34 and antifriction material 41 fixed to the legs 35.

In accordance with the teachings of this invention the backing material 40 and backing material 41 have different wear characteristics and hence are preferably different materials. Further, the wear characteristics are determined by the different wear rates to which the materials 40 and 41 are subjected.

Figure 5:
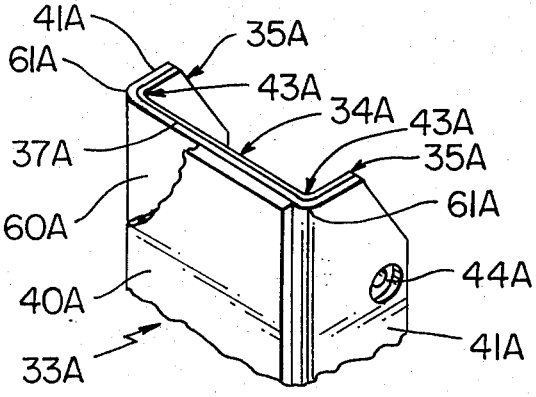
FIG. 5 is a fragmentary view similar to the top portion of FIG. 3 illustrating another exemplary embodiment of the pedestal liner of this invention which may be used interchangeably with the pedestal liner of FIG. 3.

As seen in FIGS. 4–5 of the drawings the antifriction materials 40 and 41 are bonded to the backing material 37 with a rectangular exposed strip 42 of backing material 37 at opposite sides of the antifriction material 40 comprising the bight 34. The two exposed strips 42 of backing material 37 are suitably formed each on a generous radius, shown at 43 in FIG. 3, to define an integral smooth interconnection between the bight 34 and an associated parallel leg 35.

Each pedestal liner 33 has means for fastening such liner to its pedestal leg 23. Such fastening means comprises at least one pair of aligned bores in the legs 35 and in this example two pairs of such aligned bores are illustrated (FIGS. 3 and 4) and each bore of each pair of bores is designated by the same reference numeral 44. Each bore 44 is particularly adapted to receive an associated fastener or fastening bolt 45 therethrough for fastening the associated pedestal liner to a pedestal leg 23. The fastening means for each pedestal liner 33 of this example is shown simply as pairs of aligned bores; however, if desired a tubular insert (not shown) may be used with each bore 44 and held in a bonded manner by the antifriction material 41 of its associated leg 35 to prevent high pressure from being exerted on the polymeric material surrounding its bore by an associated fastener 45 and thus prevent cold flow of antifriction material 41 from around the area of its associated bore 44 upon employing a fastener to fasten the legs 35 to an associated pedestal leg 23.

The antifriction material 41 for the legs 35 of pedestal liner 33 is of the same thickness as indicated at 51 and such thickness is different from the thickness 52 of the antifriction material 40 comprising the bight 34. Preferably the thickness 52 is substantially greater than the thickness 51.

As indicated earlier, the antifriction materials 40 and 41 are different antifriction materials and materials which may be used include polyethylene or nylon useable for either material 40 comprising the bight 34 or material 41 comprising the legs 35. In some applications it is believed better to use nylon as the material 40 comprising the bight 34 and ultra high molecular weight polyethylene as the material 41 for the parallel legs. The ultra high molecular weight polyethylene preferably has a molecular weight of at least two million with the preferred range being between four and six million.

The pedestal liner 33 may be made by fixing polymeric material 40 and 41 on a flat sheet of material 37 having the outline shown in FIG. 4 and having the bores 44. The fixing of the polymeric material 40–41 in position may be achieved by molding around a metal structure which is fixed against the backing material 37 or by molding against a rubbber interconnecting layer employing a special mold device for introduction of polymeric material to define the polymeric portions 40 and 41. The polymeric material may be provided in powder, flake, or pellet form and is heated under controlled temperatures and pressures in the mold device to define a molten state for such polymeric material. Similarly, the molding action may be achieved using a molten polymeric material provided from a suitable extruder, or the like. The mold device is made as is known in the art to define the shapes of portions 40 and 41 while defining rectangular voids on opposite sides of portion 40 which expose the substrate 37 and define the previously mentioned rectangular cutouts.

After the molding action is achieved the mold device and flat assembly or workpiece 59 of FIG. 4 are cooled and larger counterbored holes formed in the polymeric material 41 in alignment with the holes 44. The larger counterbored holes may receive rigid washer-like inserts (not shown) to prevent the bolt 45 from urging against the polymeric material and causing cold flow thereof. The workpiece 59 is then suitably bent or formed into the U-shape shown in FIG. 3 with generous radii 43 formed in the rectangular portions 42 of the backing material.

Another exemplary embodiment of the pedestal liner of this invention is illustrated in FIG. 5 of the drawing. The pedestal liner of FIG. 5 is very similar to the pedestal liner 33; therefore, such pedestal liner will be designated by the reference numeral 33A and representative parts of such pedestal liner which are similar to corresponding parts of the pedestal liner 33 will be designated in the drawings by the same reference numeral as in the pedestal liner 33 (whether or not such representative parts are mentioned in the specification) followed by the letter designation A. Only those component parts of the pedestal liner 33A which are different from corresponding parts of the pedestal liner 33 will be designated by new reference numerals each also followed by the letter designation A.

The pedestal liner 33A is also of generally U-shaped configuration consisting of a bight 34A and a pair of legs 35A and such pedestal liner also comprises a backing material 37A. In addition, the pedestal liner 33A has fastening means including aligned bores 44A identical to the bores 44 previously described and with the bores 44A having counterbores in the polymeric material for receiving metal or similar washer-like inserts for reasons mentioned earlier.

The main difference between the pedestal liner 33A and the pedestal liner 33 is that the pedestal liner 33A has a single continuous thickness of antifriction material in the form of a polymeric material extending across the bight portion 34A of the liner 33A as well as against the leg portions 35A. In addition, an outer layer or thickness 40A of antifriction material which extends across the bight 34A whereby, in essence, the bight 34A has a double thickness portion of polymeric material consisting of the inner layer or thickness 41A and the outer layer or thickness 40A.

In accordance with the teachings of this invention the antifriction material 41A for the legs 35A is a different antifriction material than the antifriction material 40A for the bight and for similar reasons as previously explained. In addition, it will be appreciated that the layer 41A which extends as a U-shaped layer may be made of ultra high molecular weight polyethylene, or the like, having a molecular weight as previously described while the layer 40A may be made of a different polymeric material such as nylon. It will also be appreciated that these two layers may be reversed, i.e., layer 41A being made of nylon and layer 40A being made of ultra high molecular weight polyethylene. However, regardless of how the layers 41A and 40A are interchanged the inner layer 41A is suitably bonded in position employing any technique known in the art; and, it has been found that the bonding of an outer polymeric layer 40A against an inner polymeric layer 41A is easily achieved using known techniques.

As indicated earlier each inner layer of polymeric material which is bonded against the substrate, whether substrate 37 or 37A, may be bonded employing any technique known in the art and the bonding action may be achieved employing mold devices, casting techniques, extrusion apparatus, or other apparatus and techniques known in the art.

It will also be seen that the double-layer construction comprising bight 34A of liner 33A is substantially thicker than the antifriction material 41A of the legs 35A. As in the case of portion 40 of liner 33 such double-piece construction is roughly several times the thickness of portion 41A.

The antifriction material 41A is defined as a single-piece which is designated 60A and is free of rectangular cutouts. Upon bending a substantially flat workpiece (which is similar to workpiece 59) to define the U-shaped pedestal liner 33A arcuate portions 61A are defined in the single-piece polymeric material 60A which overlie arcuate portions 43A of the backing material 37A.

Reference has been made to the use of ultra high molecular weight material such as polyethylene to define the antifriction material portions of liners 33 and 33A. It is to be understood that the preferred technique for determining this molecular weight is referred to as the intrinsic viscosity test and is widely used in the United States.

While present exemplary embodiments of this invention, and methods of practicing the same, have been illustrated and described, it will be recognized that this invention may be otherwise variously embodied and practiced within the scope of the following claims.

What is claimed is:

1. In a pedestal liner for a railway vehicle wherein said vehicle comprises; pedestal trucks comprising pairs of pedestal legs and a journal box disposed between each pair of pedestal legs, each journal box having a vertically disposed planar central guide surface and a pair of spaced vertically disposed parallel side surfaces disposed on opposite sides of said guide surface; said pedestal liner being roughly U-shaped having a bight and a pair of parallel legs and being for disposal between an associated pedestal leg and journal box and comprising a continuous uninterrupted metal backing material defining said bight and parallel legs; the improvement comprising, a first antifriction material for said bight supported by said backing material and adapted to engage said guide surface, a second antifriction material for said parallel legs supported by said backing material and adapted to engage said side surfaces, said backing material providing optimum structural support for said antifriction materials, and said first and second antifriction materials being polymeric materials having different wear characteristics.

2. A pedestal liner as set forth in claim 1 in which said first antifriction material for said bight is a single thickness material fixed against said backing material.

3. A pedestal liner as set forth in claim 1 and further comprising a layer of said second antifriction material fixed against said bight portion of said backing material and wherein said first antifriction material is bonded against said layer of said second antifriction material.

4. A pedestal liner as set forth in claim 1 in which one of said polymeric antifriction materials is an ultra high molecular weight polyethylene and the other of said polymeric antifriction materials is nylon.

5. A pedestal liner as set forth in claim 3 in which said ultra high molecular weight polyethylene consists of polyethylene having a molecular weight in the range of four to six million.

6. A pedestal liner as set forth in claim 4 and further comprising means for fastening said pedestal liner to its pedestal leg, said fastening means comprising at least one pair of aligned bores in said legs for receiving a fastener therethrough.

7. A pedestal liner as set forth in claim 4 in which said polyethylene has a molecular weight of at least two million.

8. A pedestal liner as set forth in claim 1 in which said second antifriction material for said parallel legs is a single thickness material fixed against said backing material.

9. A pedestal liner as set forth in claim 8 in which said first antifriction material for said bight is a single thickness material fixed against said backing material.

10. A pedestal liner as set forth in claim 8 in which said second antifriction material for said legs is of the same thickness and said first antifriction material for said bight has a thickness greater than said same thickness.

* * * * *